US009062357B2

(12) United States Patent
Gripenberg et al.

(10) Patent No.: US 9,062,357 B2
(45) Date of Patent: Jun. 23, 2015

(54) ANNEALING OF COLD ROLLED METAL STRIP

(75) Inventors: Henrik Gripenberg, Täby (SE); Johannes Lodin, Älvsjö (SE); Lennart Rangmark, Älvsjö (SE); Ola Ritzén, Akersberga (SE); Sören Wiberg, Ekerö (SE)

(73) Assignee: LINDE AG, Munich (DE)

( * ) Notice: Subject to any disclaimer, the term of this patent is extended or adjusted under 35 U.S.C. 154(b) by 988 days.

(21) Appl. No.: 12/820,340

(22) Filed: Jun. 22, 2010

(65) Prior Publication Data

US 2010/0319821 A1 Dec. 23, 2010

(30) Foreign Application Priority Data

Jun. 23, 2009 (SE) ..... 0900850

(51) Int. Cl.

| | |
|---|---|
| ***C22F 1/04*** | (2006.01) |
| ***C21D 1/52*** | (2006.01) |
| ***C21D 9/56*** | (2006.01) |
| ***C21D 11/00*** | (2006.01) |
| *C21D 1/26* | (2006.01) |

(52) U.S. Cl.

CPC .. *C21D 1/52* (2013.01); *C21D 1/26* (2013.01); *C21D 9/562* (2013.01); *C21D 11/00* (2013.01); *C22F 1/04* (2013.01)

(58) Field of Classification Search

USPC ..... 148/695

See application file for complete search history.

(56) References Cited

U.S. PATENT DOCUMENTS

| | | | | |
|---|---|---|---|---|
| 3,909,316 | A * | 9/1975 | Hirata | 148/601 |
| 5,052,661 | A * | 10/1991 | Dunlay et al. | 148/511 |
| 5,976,279 | A * | 11/1999 | Selepack et al. | 148/551 |
| 2007/0160948 | A1 * | 7/2007 | Gartz | 432/146 |
| 2010/0175452 | A1 * | 7/2010 | Ohlert et al. | 72/200 |

FOREIGN PATENT DOCUMENTS

DE 102008010062 A1 * 12/2008 ..... C21D 8/02

* cited by examiner

*Primary Examiner* — Rebecca Lee

(74) *Attorney, Agent, or Firm* — Young & Thompson

(57) ABSTRACT

A cold rolled strip (3) of aluminum is continuously transported along a transport path where a ramp of Direct Flame Impingement (DFI) burners (1) are located, for heating the strip. The ramp (1) is located perpendicular, or substantially perpendicular, to the direction of movement of the strip (3), the DFI burners (1) are mutually located such that the whole width of the strip (3) is heated to the same, or substantially the same, temperature. The velocity of the strip (3) passing the ramp and the heating power of the burners (1) are adapted to heat treat the strip (3) such that annealing of the strip is carried out and the heat treated strip is wound to a coil (5).

17 Claims, 3 Drawing Sheets

ANNEALING OF COLD ROLLED METAL STRIP

FIELD OF THE INVENTION

The invention relates to the field of annealing aluminium strips.

BACKGROUND OF THE INVENTION

It is state of the art to anneal cold rolled aluminium strips at 250-500° C. The purpose is to restore good formability.

The mechanisms are removal of dislocation pile-ups (partial annealing) and recrystallization (annealing).

The recrystallization process is among others depending on time and temperature. For example at 500° C. recrystallization takes a few seconds, at 380° C. a few minutes and at 280° C. a few hours. Other factors are alloy composition and the amount of cold work prior to the annealing.

The partial annealing take place at 200-300° C. for prolonged times up to 15 hours.

For aluminium strip coils a car bottom box furnace is normally used. The furnace is either heated by electrical elements or by fuel heated elements. To get good convection and temperature homogeneity in the furnace powerful fans are used to circulate the furnace atmosphere. The car bottom box furnace represents a significant investment.

The Direct flame impingement (DFI) technique, where multiple oxyfuel burner flames directly hits and heats a moving steel strip is a technology previously developed and patented. DFI burners are normally fed with fuel and an oxidant having a high oxygen content. It is preferred to use an oxidant having at least 80% by weight oxygen. Using DFI burners provides a high heat transfer from the flame to the steel strip and thus a very high heating rate.

However, DFI burners when fired with an oxidant with a high oxygen content, give a very high output power and a high flame temperature, such as 2500° C.

In spite of this fact it has surprisingly been found out that it is possible to heat an aluminium strip very fast to a desired temperature without suffering from surface damages such as local melting on the surface of the strip. Aluminium has a melting point of approximately 660° C.

There is a problem with annealing according to prior art. Prior art coil annealing is a slow process. It is characterized by inefficient heating and low thermal conductivity between the layers of aluminium strip within the coil. This leads to long process times, low productivity and high energy consumptions.

A second problem is the risk of explosions from evaporated lubricants from the surface of the coiled material igniting with air inside the furnace.

A third problem is discolorations on the strip surface owing to reactions between the rolling lubricant, the metal and the atmosphere.

A forth problem is that a long process time can cause a growth of the oxide layer on the strip surface leading to reduced soldering properties and other negative effects.

A fifth problem is that temperature gradients arise within the coil during the heat treatment. In partial annealing of coils there is a risk that the outer layers of the coil are heat treated at a different time temperature profile than the inner layers and this could lead to variations in mechanical properties.

The present invention solves all of the above mentioned problems.

SUMMARY OF THE INVENTION

The present invention thus refers to a method for annealing cold rolled aluminium strips, and is characterised in, that a cold rolled strip of aluminium is continuously transported along a transport path where a ramp of Direct Flame Impingement (DFI) burners are located, for heating the strip, in that said ramp is located perpendicular, or substantially perpendicular, to the direction of movement of the strip, in that the DFI burners are mutually located such that the whole width of the strip is heated to the same, or substantially the same, temperature, in that the velocity of the strip passing the said ramp and the heating power of said burners are adapted to heat treat the strip such that annealing of the strip is carried out and in that the heat treated strip is wound to a coil.

BRIEF DESCRIPTION OF THE DRAWINGS

The present invention is described in more detail below, partly in connection with exemplifying embodiments illustrated in the accompanying drawings, where.

DETAILED DESCRIPTION OF THE INVENTION

Figure 1:
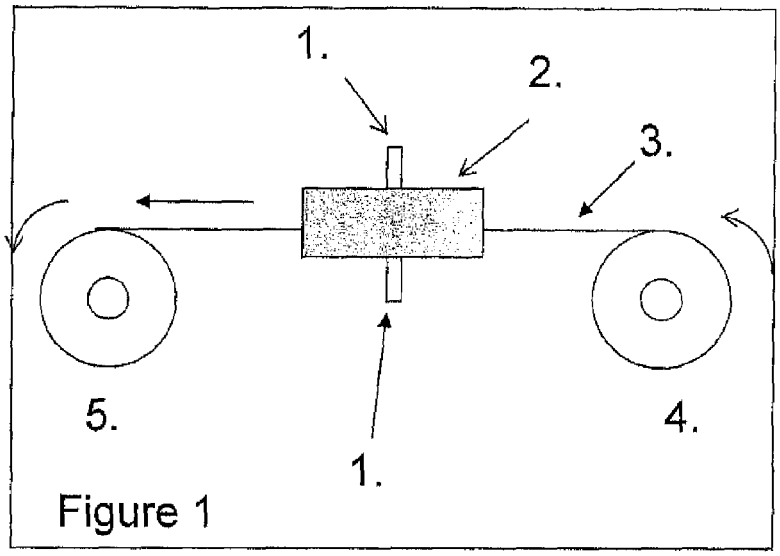
FIG. 1 illustrates a first embodiment of the present invention

FIG. 1 illustrates a first embodiment of the present method for annealing cold rolled aluminium strips 3.

According to the invention a cold rolled strip 3 of aluminium is continuously transported along a transport path where a ramp 1 of Direct Flame Impingement (DFI) burners are located, for heating the strip. According to this embodiment the cold rolled aluminium strip is unwound from a coil 4. Said ramp 1 is located perpendicular, or substantially perpendicular, to the direction of movement of the strip 3. Further, the DFI burners are mutually located such that the whole width of the strip is heated to the same, or substantially the same, temperature. The velocity of the strip 3 passing the said ramp 1 and the heating power of said burners are adapted to heat treat the strip 3 such that annealing of the strip is carried out and in that the heat treated strip is wound to a coil 5.

According to one embodiment of the invention, the velocity of the strip 3 passing the said ramp 1 and the heating power of said burners are adapted to heat treat the strip 3 such that recrystallization of the strip is carried out.

According to another preferred embodiment there is at least one ramp 1 above and at least one ramp 1 below said transport path of said strip 3.

Experiments have been carried out with a cold rolled and coiled aluminium strip having a material thickness of 1 mm. The strip was passed one ramp of DFI burners located above the strip and one ramp of burners located below the strip. Each burner ramp had four burners. The total power generated by the burners was 200 KW. At a strip speed passing the burners of 24 m/sec the temperature of the strip became 400° C. At a speed of 30 m/sec the temperature obtained was 365° C. No surface damages were observed.

It is deemed that the present invention is preferably used for strips having a thickness between 0.5 mm to a maximum thickness at which the strip can be coiled.

According to a preferred embodiment of the invention there are two or more successive ramps 1 of DFI burners located after each other along the transportation path.

It is preferred that the ramp 1 or ramps are located in a furnace. However, in some applications the ramp or ramps can be mounted in a frame without a surrounding housing.

Figure 2:
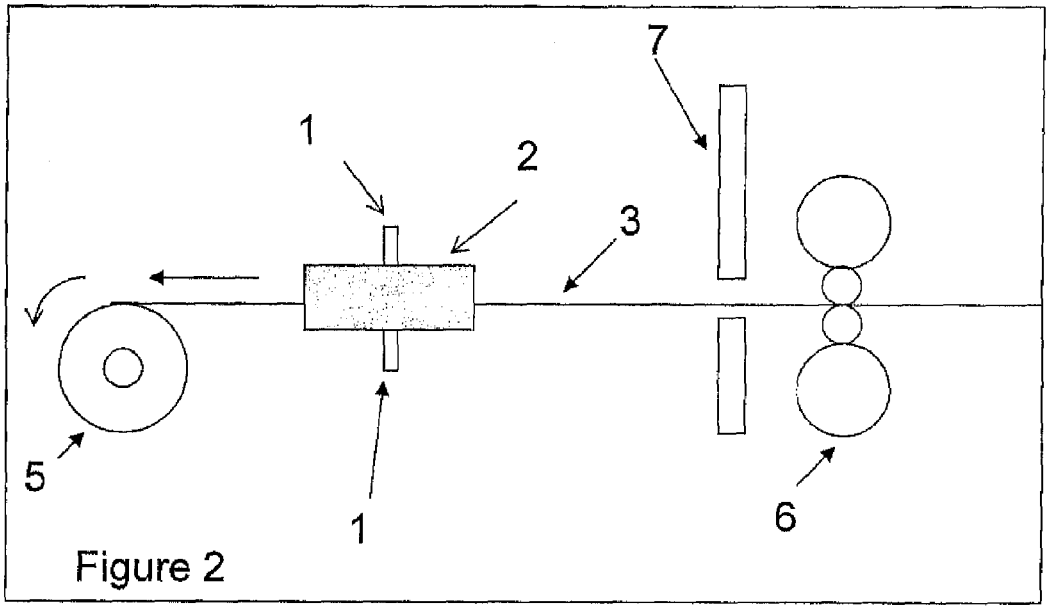
FIG. 2 illustrates a second embodiment of the present invention

According to a second embodiment of the invention a cold rolled aluminium strip 3 is lead directly from a rolling stand 6 to said transportation path, please see FIG. 2. According to this embodiment a safety wall 7 is located between the DFI furnace 2 and the rolling stand because lubricants used when rolling may be flammable.

Figure 3:
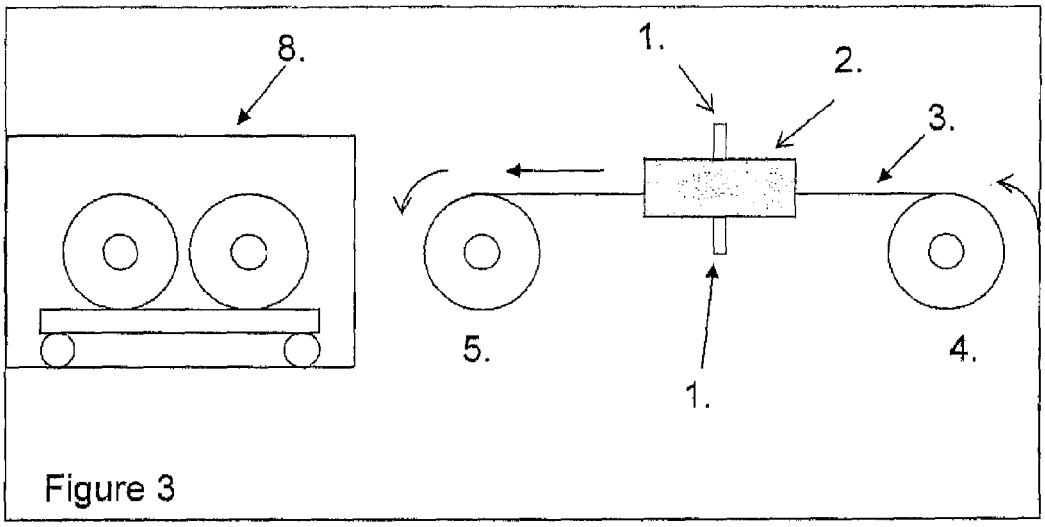
FIG. 3 illustrates a third embodiment of the present invention

According to a third embodiment of the invention, illustrated in FIG. 3, a heat treated and coiled strip 5 is placed in a soaking furnace 8 for partial annealing, i.e. for removal of dislocations. The soaking furnace shall preferably be filled with nitrogen gas in order to minimize oxide growth.

In such case the soaking furnace is kept at a temperature which corresponds to the temperature of the aluminium strip obtained by heating by said DFI burners. Thereby it is obtained that annealing of the coiled aluminium strip is started immediately in the soaking furnace throughout the whole coil.

Figure 4:
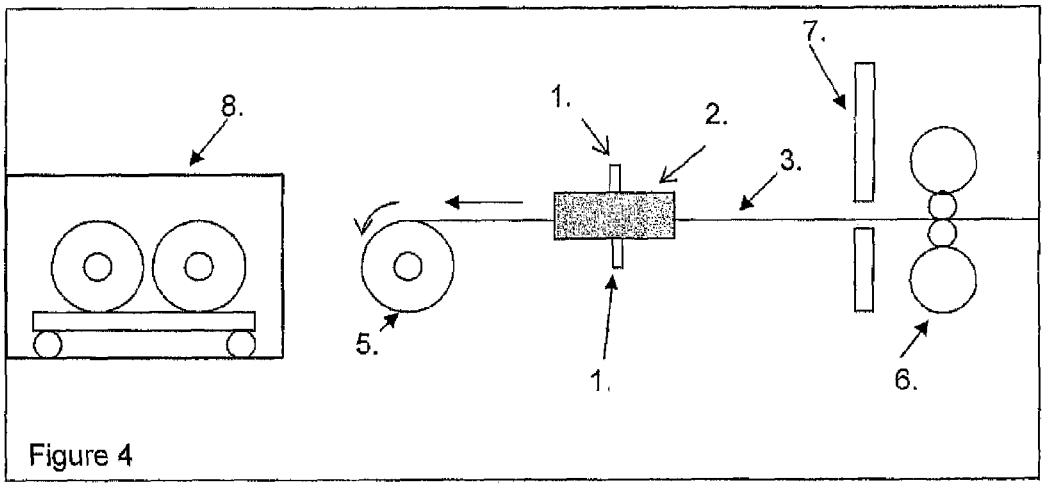
FIG. 4 illustrates a fourth embodiment of the present invention

FIG. 4 illustrates that a cold rolled aluminium strip 3 is lead directly from a rolling stand to said transportation path, i.e. DFI furnace, whereafter it is coiled and placed in a soaking furnace.

Figure 5:
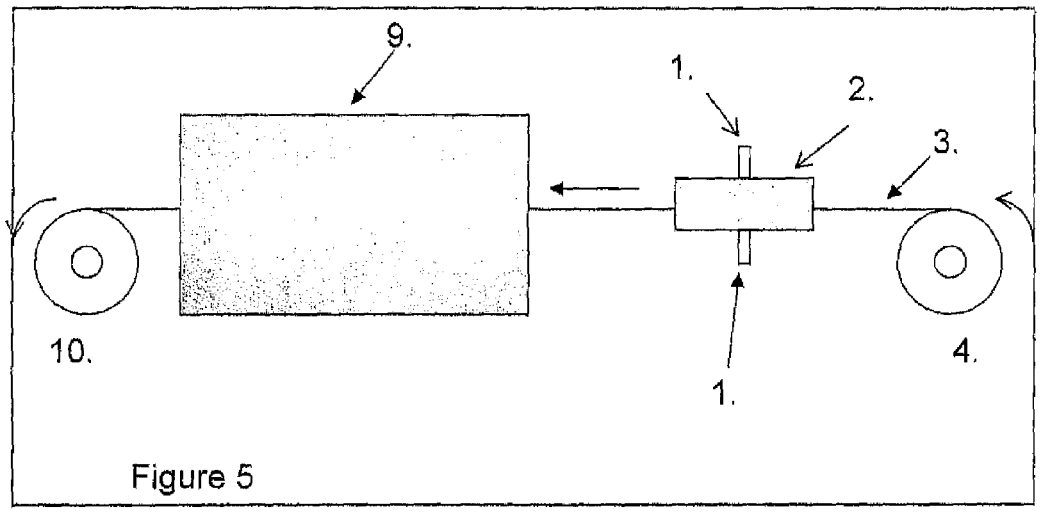
FIG. 5 illustrates a fifth embodiment of the present invention

FIG. 5 illustrates a fifth embodiment of the invention, where a cold aluminium strip 3 is unwound from a coil 4, heat treated in the DFI furnace 2 and lead through a continuous soaking furnace 9, whereafter it is coiled 10.

Figure 6:
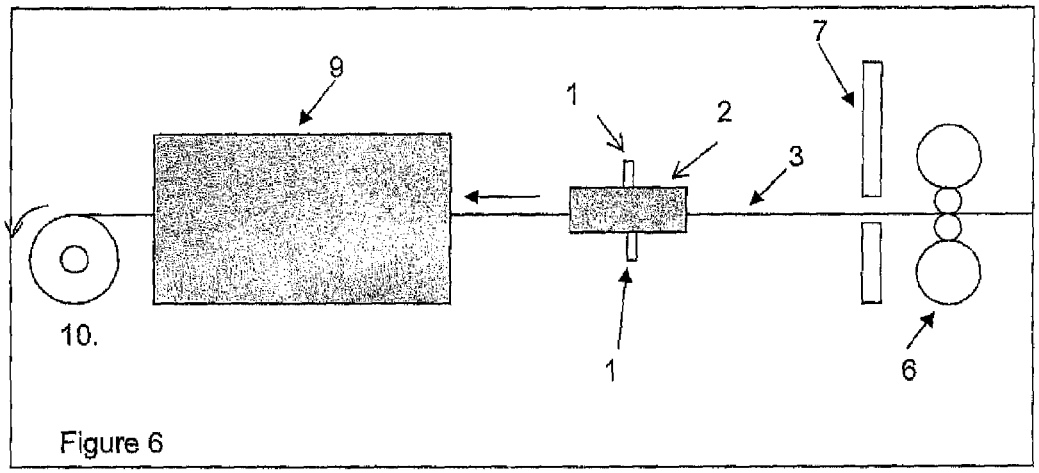
FIG. 6 illustrates a sixth embodiment of the present invention.

FIG. 6 illustrates the embodiment illustrated in FIG. 5, but where the cold aluminium strip 3 is lead directly from a rolling stand 6 to said transportation path, i.e. DFI furnace 2, whereafter it is lead through a continuous soaking furnace 9, whereafter it is coiled 10.

By the present invention all of the problems mentioned in the opening part are solved. Further, a very fast process is obtained since the strip is heated while it is unwound.

Above several embodiments of the invention have been described. However, The invention can be varied by the man skilled in the art without deviate from the inventive idea.

Thus, the present invention shall not be restricted to the embodiments described above, but can be varied within the scope of the attached claims.

The invention claimed is:

1. A method for annealing cold rolled aluminium strips, comprising:

unwinding a cold rolled strip of aluminium, said cold rolled strip of aluminium being a cold coil of an aluminium strip;

heat treating the unwound strip of aluminium by continuously transporting the strip along a transport path where at least one ramp of Direct Flame Impingement (DFI) burners are located; and winding the heated strip into a coil, wherein the strip has a thickness has a thickness between 0.5 mm and a maximum thickness at which the strip can be coiled, wherein said at least one ramp is located perpendicular, or substantially perpendicular, to the direction of movement of the strip, wherein the DFI burners are mutually located such that the whole width of the strip is heated to the same, or substantially the same, temperature, wherein the DFI burners use an oxidant having at least 80% by weight oxygen, and wherein the velocity of the strip passing said at least one ramp and the heating power of said burners are selected to heat treat the strip such that annealing of the strip is carried out without causing surface damages.

2. The method according to claim 1, wherein there is at least one ramp above and at least one ramp below said transport path of said strip.

3. The method according to claim 1, wherein there are two or more successive ramps of DFI burners.

4. The method according to claim 1, wherein the at least one ramp is located in a furnace.

5. The method according to claim 1, wherein the unwound strip is lead directly from a rolling stand to said transportation path.

6. The method according to claim 1, further comprising placing the heat treated and coiled strip in a soaking furnace for partial annealing for removal of dislocations.

7. The method according to claim 1, wherein there are two or more successive ramps of DFI burners.

8. The method according to claim 2, wherein the at least one ramp is located in a furnace.

9. The method according to claim 2, wherein the unwound strip is lead directly from a rolling stand to said transportation path.

10. The method according to claim 2, further comprising placing the heat treated and coiled strip in a soaking furnace for partial annealing for removal of dislocations.

11. A method for annealing cold rolled aluminium strips, comprising:

continuously unwinding and heat treating a cold rolled strip of aluminium by continuously transporting the strip from a rolling stand along a transportation path, where at least one ramp of Direct Flame Impingement (DFI) burners are located; a safety wall being located between the DFI burners and the rolling stand to prevent exposing lubricants used in the rolling stand to the DFI Burners, and winding the heated strip into a coil, wherein the strip has a thickness has a thickness between 0.5 mm and a maximum thickness at which the strip can be coiled, wherein said at least one ramp is located perpendicular, or substantially perpendicular, to the direction of movement of the strip, wherein the DFI burners are mutually located such that the whole width of the strip is heated to the same, or substantially the same, temperature, wherein the DFI burners use an oxidant having at least 80% by weight oxygen, and wherein the velocity of the strip passing said at least one ramp and the heating power of said burners are selected to heat treat the strip such that annealing of the strip is carried out without causing surface damages.

12. The method according to claim 11, wherein there is at least one ramp above and at least one ramp below said transport path of said strip.

13. The method according to claim 11, wherein there are two or more successive ramps of DFI burners.

14. The method according to claim 11, wherein the at least one ramp is located in a furnace.

15. The method according to claim 11, further comprising placing the heat treated and coiled strip in a soaking furnace for partial annealing for removal of dislocations.

16. The method according to claim 11, wherein there are two or more successive ramps of DFI burners.

17. A method for annealing cold rolled aluminium strips, comprising:

continuously unwinding and heating a cold rolled strip of aluminium along a transportation path where at least one ramp of DirectFlame Impingement (DFI) burners is located substantially perpendicular to the direction of movement of the strip, said DFI burners positioned relative to the strip such that recrysallization across the width of the strip is carried out, said DFI burners using a fuel and an oxidant having at least 80% by weight oxygen;

continuously leading the heated strip into a soaking furnace filled with nitrogen for partial annealing for removal of dislocations; and continuously coiling the strip from said soaking furnace, wherein the strip has a thickness has a thickness between 0.5 mm and a maximum thickness at which the strip can be coiled, and wherein the velocity of the strip passing said burners is selected to heat treat the strip such that annealing of the strip is carried out without causing surface damages.

* * * * *